United States Patent [19]

Jones

[11] Patent Number: 4,498,675

[45] Date of Patent: Feb. 12, 1985

[54] BOARD GAME WITH QUOITS MOVEMENT INDICATOR

[76] Inventor: William P. Jones, P.O. Box 297, Rochester, Wash. 98579

[21] Appl. No.: 488,173

[22] Filed: Apr. 25, 1983

[51] Int. Cl.[3] ..... A63F 3/00; A63F 9/02

[52] U.S. Cl. ..... 273/249; 273/337; 273/338; 273/287; 273/352

[58] Field of Search ..... 273/249, 337, 338, 287, 273/352

[56] References Cited

U.S. PATENT DOCUMENTS

| | | | |
|---|---|---|---|
| 1,153,395 | 9/1915 | Lehman | 273/249 |
| 2,442,194 | 5/1948 | Briscoe | 273/249 |
| 2,472,719 | 6/1949 | Mysels | 273/338 |
| 2,729,451 | 1/1956 | Larson | 273/244 X |
| 4,019,739 | 4/1977 | Waite | 273/129 L X |
| 4,216,594 | 8/1980 | Farley et al. | 273/249 X |
| 4,357,017 | 11/1982 | Schneider et al. | 273/246 |

FOREIGN PATENT DOCUMENTS

| | | | |
|---|---|---|---|
| 637984 | 5/1950 | United Kingdom | 273/337 |

*Primary Examiner*—Richard C. Pinkham
*Assistant Examiner*—Scott L. Brown
*Attorney, Agent, or Firm*—Thomas W. Secrest

[57] ABSTRACT

This invention is directed to a board game having a playing track comprising a number of distinct areas of different colors. There is also an area for pegs having colors and which colors correspond to the colors of the discrete areas. A person moves and directs a ring toward the peg. With the ring moving over the peg and positioning itself on the peg, the person can advance an indicator to a discrete area of a color corresponding to the color of the peg. It is possible for young children who cannot read or write to play this game as the game is based on color. To assist those who are color blind, there is also a letter indicating the color and a person who is color blind can play the game. The game is such that people of a very young age through people of an advanced age in their seventies and eighties can play the game for amusement and pleasure.

18 Claims, 4 Drawing Figures

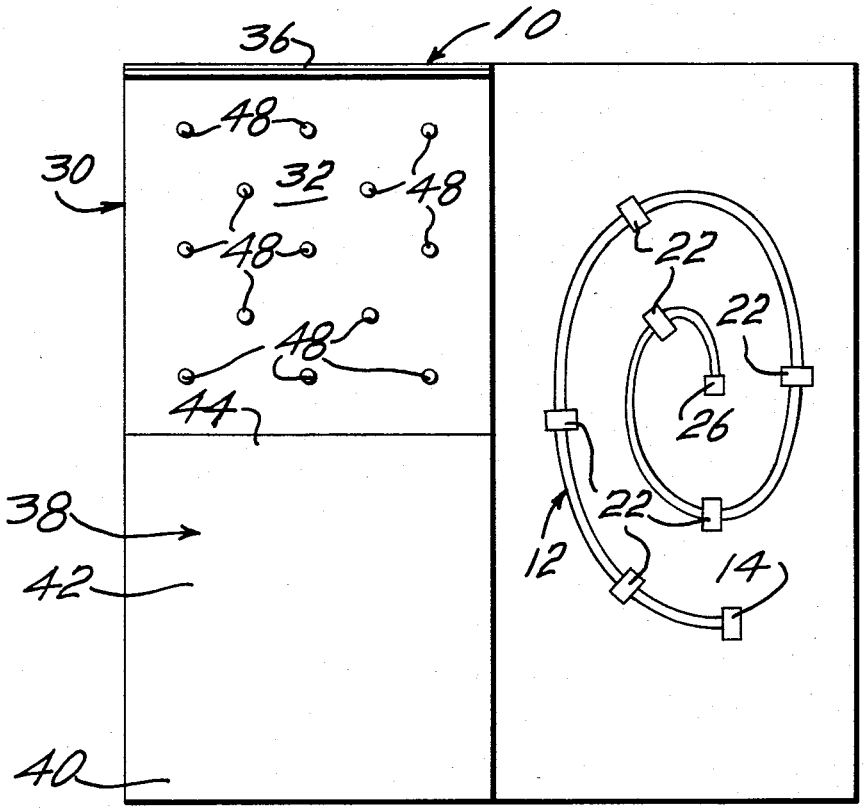
FIG. 4
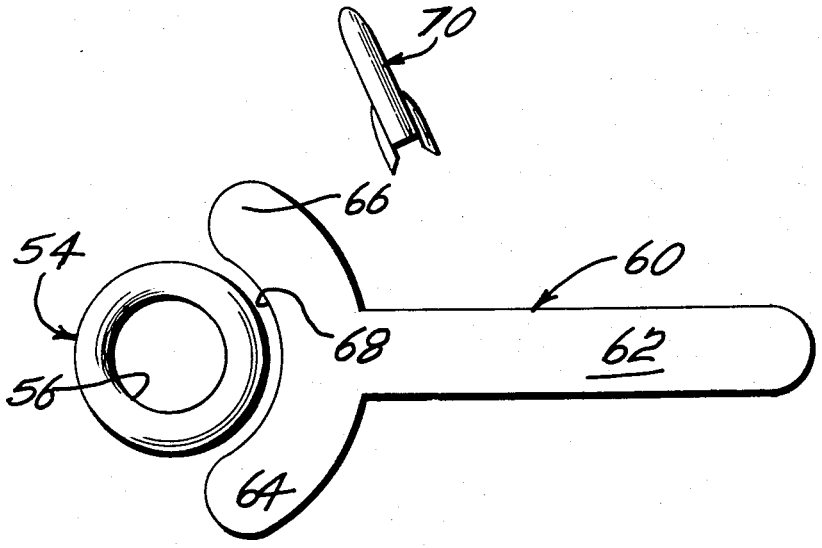

BOARD GAME WITH QUOITS MOVEMENT INDICATOR

THE BACKGROUND OF THE INVENTION

Board games are popular with a number of different people of different ages and of different relationships. For example, brothers and sisters and neighborhood children can play board games and becomes better acquainted. On those days when the weather is unpleasant, the neighborhood children can gather in a friendly atmosphere and play board games and have a good time.

Parents and children often will play board games to amuse themselves and also to form a more well acquainted and tightly knit family.

At other times adults will play board games to relax and forget about the every day cares of the world and also to have a social interchange among themselves and to get to know each other better.

Board games have been known and in existance for many hundreds of years. Some of the board games such as chess are designed so that only two players can play at one time. Checkers is another game that only two players can play at one time. Then, there are many other board games that two or three and four or more players can play and test their skills against each other and have a good time.

THE GENERAL DESCRIPTION OF THE INVENTION

This invention is a board game having a playing area having a curved path which is a track. The curved path or track is composed of squares of different colors. Another part of the board comprises upright pegs and a ring for moving up an inclined plane and for falling over one of the pegs. The pegs are of different colors. The ring upon encircling one of the pegs indicates that the owner of that ring advances the rocket to the next square of that color.

A form of skill is involved in that the player in propelling the ring up the slide must be careful so as to have the ring fall upon one of the upright pegs. In addition to the skill there is also the game of chance of the ring falling upon an upright peg of the desirable color. In fact, the ring may not fall upon any peg. Then, the player has lost an opportunity to advance the rocket to the next appropriate square in the track or path.

THE DRAWINGS

FIG. 4 is a top plan view of the board game and illustrates the curved path which is the track, the upright peg area, the slide area, the ring and the rocket as well as a ring pusher for pushing and manuevering the ring on the slide area.

THE SPECIFIC DESCRIPTION OF THE INVENTION

With reference to the drawings it is seen that there is a playing board 10.

Figure 1:
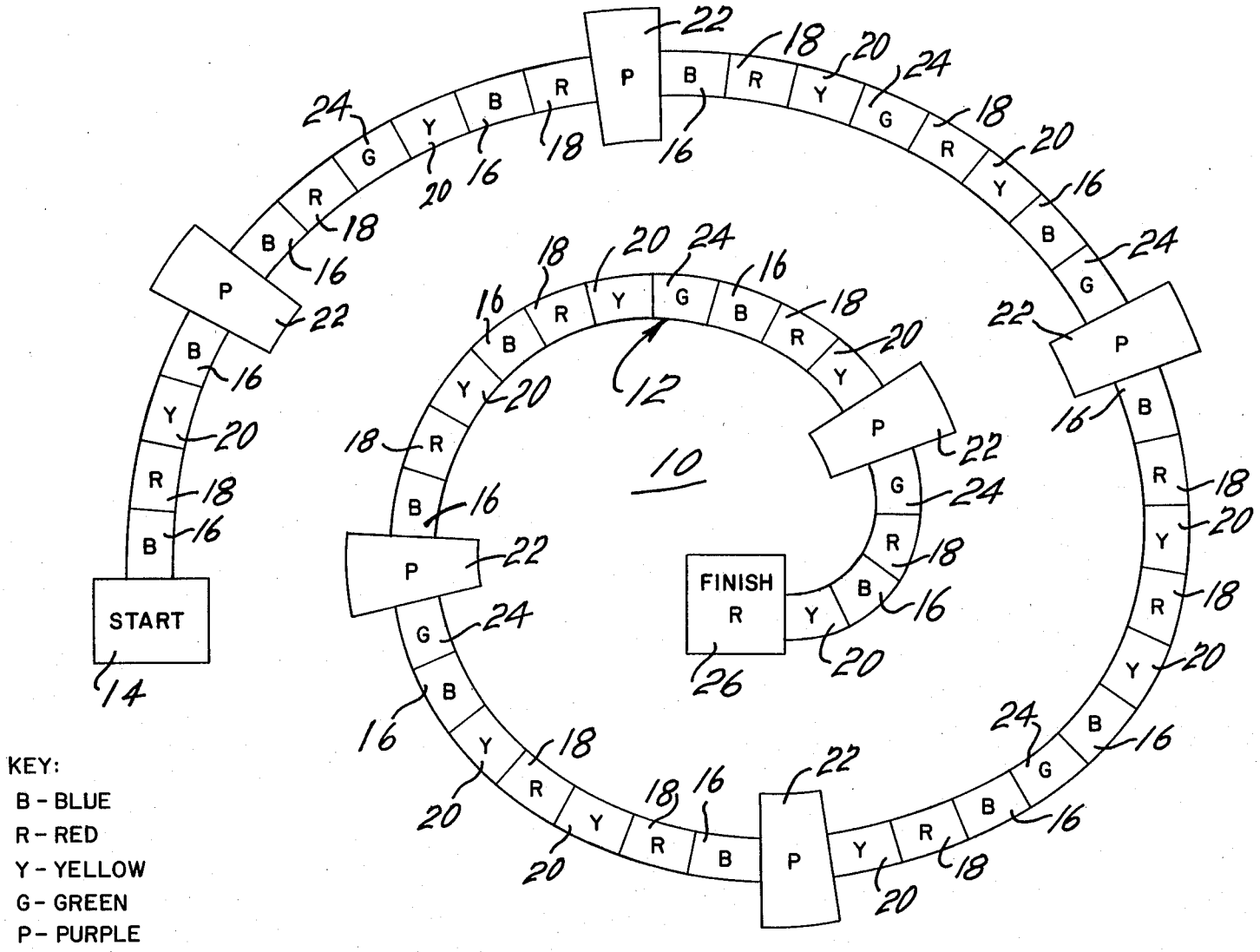
FIG. 1 is a top plan view looking down upon part of the playing area comprising the curved path composed of squares of different colors and also indicating the starting square and the finishing square.

On the playing board 10 there is a playing track 12. The playing track 12 comprises a plurality of areas. These areas are divided into discrete portions. As is seen in FIG. 1 these areas may be in the configuration of a rectangle or a square. The playing track 12 appears to be in the general configuration of a helix. The areas are discrete. However, the areas on their ends border an adjacent area. All of the areas, except two, border two adjacent areas. The start area 14 does not border two adjacent areas but does border the area 16. The area 16 borders the area 18. The area 18 borders the area 20. It is seen that the area 18 borders both the area 16 and the area 20. The areas have indicia. For example, the area 14 has the indicia start. The area 16 has the letter B and is also colored blue. The area 18 has the letter R and is colored with red. The area 20 has the letter Y and is colored yellow. Then, the letter 20 borders another letter 16 which has indicia and is colored blue. The area 16 which borders the area 20 also borders the area 22 which has indicia P and is colored purple. There is an area 24 which has the letter G and is colored green. These areas have a recognizable letter and also a recognizable color. The innermost and last area has the indicia Finish and is given reference numeral 26. The reader is to understand that the starting place can be at the inner end of the playing track 12 and the finishing place can be at the outer end of the track 12.

Also, the reader is to understand that the reason for using the letters B, R, Y, G and P is that some people are color blind and may not recognize the blue color, red color, yellow color, green color and purple color.

Figure 2:
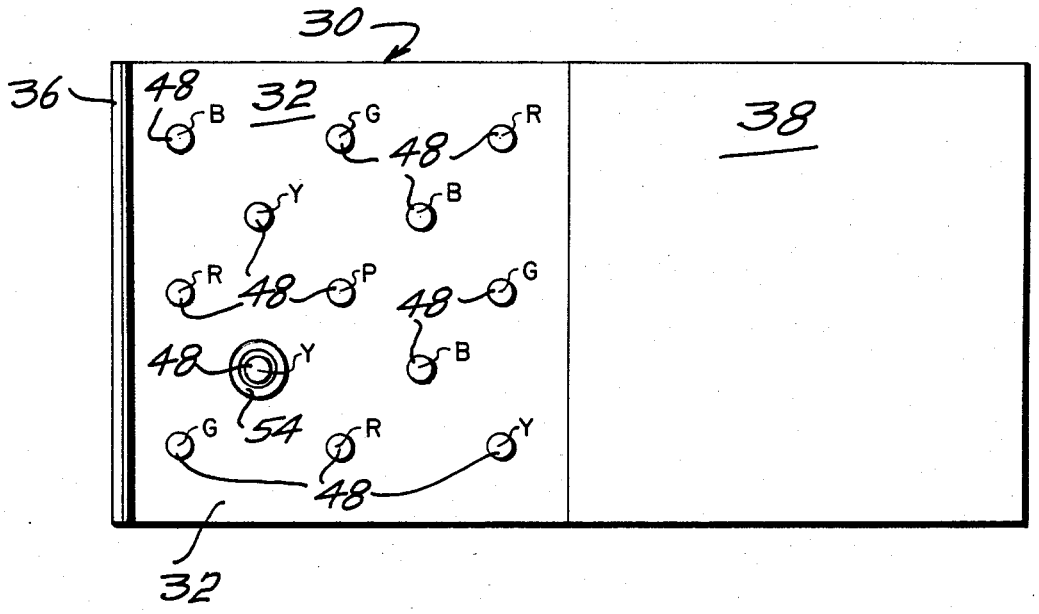
FIG. 2 is a top plan view of part of the board game and illustrates the area having the pegs and also the inclined slide to the right of the area having the pegs.
Figure 3:
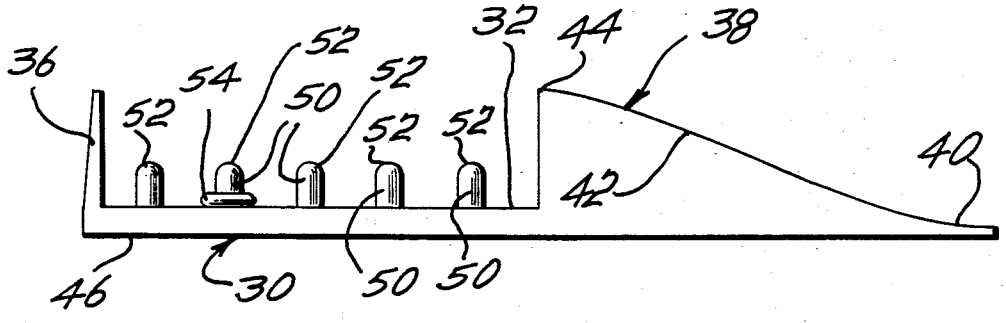
FIG. 3 is a side elevational view of part of the board game and illustrates the area having the pegs and also the area having the slide.

Part of the game comprises a peg board 30 having a peg area 32. The peg area 32 has a flat upper surface 34. In FIGS. 2 and 3 it is seen that at the left there is an outside barrier wall 36.

In FIGS. 2 and 3 it is seen that to the right that there is an inclined surface 38. The lower part of the surface 38 is at the extreme right and is given reference numeral 40 and is substantially horizontal. Then, the middle portion 42 of the surface 38 slopes upwardly to the highest part 44.

The peg board 30 has a flat lower surface 46.

In the peg area 32 there are numerous pegs 48. The pegs 48, in a lateral cross-sectional configuration, are of a right circular cylindrical form and have a rounded top 52.

In FIG. 3 it is seen that the highest part 44 of the inclined surface 38 is above the tops of the pegs 48.

There is an article in the configuration of a torus or ring 54 having a central passageway 56. The cross-sectional area of each of the pegs 48 is of a lesser dimension than the cross-sectional dimension of the central passageway 56. This makes it possible for a torus or a ring 54 to fall over the appropriate peg 48. In FIG. 2 there is illustrated the torus or ring 54 over a peg.

The minimum distance between two adjacent pegs is greater than one half of the external diameter of the torus or ring 54. Again, this allows the torus or ring 54 to fall over an appropriate peg 48 and settle downwardly onto the flat surface 34 of the peg area 32.

Again, each of the pegs 48 has an appropriate indicia such as B and is colored blue; Y and is colored yellow; G and is colored green; R and is colored red; and, P and is colored purple. Again, the reason for the letters is so that a person who is color blind can still play the game and need not depend upon the color of the peg but can depend upon the letter indicia of the peg.

There is a ring pusher 60 having a handle 62 and on one end a first branch 64 and a second branch 66. The branches 64 and 66 on their exterior surfaces define an arcuate surface 68 for co-fitting with the external surface of the torus or ring 54 and for receiving the torus or ring 54 so as to be able to push the torus or ring.

To indicate to a person playing the game the position on the playing track 12 there is provided a little rocket 70.

RESUME

From the foregoing it is seen that I have provided a board game having pegs 48 and rings 54 for falling on and encircling the pegs 48. The pegs are of different colors. There is an inclined surface. A ring is pushed up the inclined surface and then it falls downwardly and, hopefully, to encircle a peg 48. There is a playing track 12 divided into a plurality of successive areas. The successive areas have different colors. There is an indicator to indicate the position of the player on the playing track 12.

An illustration of one manner of playing the game is to assume that there are three players. The players move the ring in succession. For example, the first player moves the ring 54 up the inclined surface and the ring falls on one of the pegs 48 which has a green or a red or a yellow or a blue color. The first player then advances his indicator to the next advance area of that color.

Assume that the second player moves the ring 54 up the inclined surface 38 and the ring lands on a peg 48 that is of a purple color. Purple is a penalty color and the second player looses his next successive turn at moving the ring and advancing his indicator on the playing track 12.

The third player moves his ring 54 up the inclined surface 38 and the ring does not fall on and encircle the peg 48 but falls in between the pegs 48. The third player does not advance his indicator with this turn.

Then, the first player takes his second turn. The second player takes his second turn, and, the third player takes his second turn.

This procedure is repeated until one or more of the players crosses the finish area or finish line.

Each of the pegs 48 have a rounded top 52 to assist the ring 54 to fall over and encircle the peg.

Prior to preparing this patent application a patent search was made. This patent search disclosed U.S. Pat. No. Des. 106,454. The patent search did not disclose any pertinent utility patents. The field of the patent search included Class 273, subclasses 243 (1960 to date) 248, 249, 281, 287, 336 and 339.

I consider this invention to be new and unobvious as I do not know of a similar game and have no knowledge of a similar game. In my opinion the patent search confirms the fact that the game is new and unobvious as the patent search did not disclose a similar game or the same game.

I consider the invention to be useful as the age group which can play the game varies from a young pre-school person of the age of about four to grandparents in the seventies and eighties. A young pre-school student can play the game because the pegs are colored and also the squares are colored and also because it is not necessary for a person to be able to read and write to play the game. I consider the game to be useful as it can give pleasure and enjoyment to a number of people.

From the foregoing and having presented my invention, what I claim is:

1. A game comprising:

a. a playing track;

b. said playing track having a plurality of areas for indicating position on said playing track;

c. said plurality of areas being of different first colors;

d. said playing track having a starting place and a finishing place;

e. a selection area for selecting one of said plurality of areas for indicating position on said playing track;

f. said selection area having a first means for selecting said one of said plurality of areas for indicating position on said playing track;

g. said first means comprising various means corresponding to various areas on said playing track;

h. a second means for associating with one of said various means for selecting said one of said plurality of areas for indicating position on said playing track;

i. said first means comprising different second colors corresponding to the colors of said plurality of areas;

j. said second means associating with one of said second colors for selecting one of said first colors for indicating position on said playing track;

k. said first means comprising a plurality of pegs of a first exterior cross-sectional dimension;

l. each of said pegs having a color and having indicia indicating said color of said peg;

m. said second means being an article having a passageway of a second interior cross-sectional dimension;

n. said second interior cross-sectional dimension being larger than said first exterior cross-sectional dimension so that said article can move around said pegs; and, o. with said article around one of said pegs then said one of said pegs indicating an appropriate area for indicating position on said playing track.

2. A game according to claim 1 and comprising:

a. a pump having a lower part and an upper part juxtapositioned to said pegs;

b. said upper part being closer to said pegs than said lower part;

c. said article being positioned to move upwardly on said ramp and then off of said ramp and through the air toward said pegs; and, d. said article being capable, upon moving off said ramp and through the air toward said pegs, of encircling one of said pegs to indicate a color and an appropriate area on said playing track.

3. A game according to claim 2 and comprising:

a. a moveable indicator for association with an appropriate area on said playing area.

4. A game according to claim 2 and comprising:

a. one of said first colors being a penalty color;

b. one of said pegs having indicia indicating a penalty and which indicia corresponds to said penalty color; and, c. said playing area having an appropriate penalty area.

5. A game according to claim 2 and comprising:

a. a pusher for moving said article on said ramp;

b. said pusher being in the configuration of a Y; p1 c. said pusher having a handle, a first branch and a second branch; and, d. said first branch and said second branch having a surface for contacting said article.

6. A game according to claim 2 and comprising:

a. said article being a ring and having said passageway;

b. said ring having an external diameter; and, c. the minimum distance between adjacent said pegs being greater than one-half of the external diameter of said ring.

7. A game according to claim 2 and comprising:

a. said playing track, said pegs and said ramp being an integral unit.

8. A game according to claim 2 and comprising:

a. a moveable indicator for association with an appropriate area on said playing area;

b. one of said first colors being a penalty color;

c. one of said pegs having indicia indicating a penalty and which indicia corresponds to said penalty color;

d. said playing area having an appropriate penalty area;

e. a pusher for moving said article on said ramp;

f. said pusher being in the configuration of a Y;

g. said pusher having a handle, a first branch and a second branch;

h. said first branch and said second branch having a surface for contacting said article;

i. said article being a ring and having a passageway;

j. said ring having an external diameter;

k. the minimum distance between adjacent said pegs being greater than one-half of the external diameter of said ring;

l. said playing track, said pegs and said ramp being an integral unit;

m. said playing track being in the general configuration of a helix; and, n. an indicator for placing on an appropriate area of said playing track.

9. A method for making and playing a game, said method comprising:

a. preparing a playing track having a number of discrete areas;

b. the discrete areas having first different colors and indicia indicating said first different colors;

c. preparing a selective area having a plurality of pegs;

d. said pegs having second different colors;

e. preparing an article having a passageway for fitting over one of said pegs;

f. said first different colors and said second different colors corresponding with each other;

g. moving and directing said article toward said pegs with the expectation that said article will descend and fit over one of said pegs;

h. selecting an indicator to move on said track;

i. moving said indicator on said track to an area having a first different color corresponding to the second different color of said one of said pegs; and, j. preparing said playing track to have a starting place and a finishing place.

10. A method according to claim 9 and comprising:

a. preparing said pegs with at least one peg having a first penalty color;

b. preparing said playing track with a least one discrete area having a second penalty color; and, c. if said article moves and fits over the one of said pegs having said first penalty color then said indicator is moved to a discrete area having said second penalty color and a player playing said game loses an opportunity to move and direct said article toward said pegs.

11. A method according to claim 10 and comprising:

a. with a plurality of players said players taking turns at said moving and directing said article; and, b. with the placing of said article on said peg advancing said indicator on said playing track to next said discrete area having the corresponding color and indicia to the color and the indicia of said peg on which said article has been placed.

12. A method according to claim 11 and comprising:

a. with said moving and directing said article in the vicinity of said pegs and said article fails to fit over one of said pegs and player does not advance said indicator on the playing track.

13. A method according to claim 12 and comprising:

a. preparing an ascending ramp having an upper part and a lower part with the upper part positioned closer to said pegs than the lower part; and, b. moving said article up said ramp to fly off of said ramp and toward said pegs.

14. A method according to claim 13 and comprising:

a. preparing said playing track in the configuration of a helix.

15. A method according to claim 9 and comprising:

a. with a plurality of players said players taking turns at said moving and directing said article; and, b. with placing said article on said peg advancing said indicator on said playing track to next said discrete area having the corresponding color and indicia to the color and the indicia of said peg on which said article has been placed.

16. A method according to claim 15 and comprising:

a. with said moving and directing said article in the vicinity of said pegs and said article fails to fit over one of said pegs said player does not advance said indicator on the playing track.

17. A method according to claim 15 and comprising:

a. preparing an ascending ramp having an upper part and a lower part with the upper part positioned closer to said pegs than the lower part; and, b. moving said article up said ramp to fly off of said ramp and toward said pegs.

18. A method according to claim 17 and comprising:

a. preparing said playing track in the configuration of a helix.

* * * * *